US005417587A

United States Patent [19]

Katsuda et al.

[11] Patent Number: 5,417,587

[45] Date of Patent: May 23, 1995

[54] INSTRUMENT DIRECTLY MOUNTED SHIELDED CONNECTOR

[75] Inventors: Toshihiro Katsuda, Aichi; Shigemitsu Inaba; Hidehiko Kuboshima, both of Shizuoka, all of Japan

[73] Assignee: Yazaki Corporation, Tokyo, Japan

[21] Appl. No.: 188,412

[22] Filed: Jan. 24, 1994

[30] Foreign Application Priority Data

Jan. 22, 1993 [JP] Japan ..... 5-001305 U

[51] Int. Cl.[6] ..... H01R 13/74

[52] U.S. Cl. ..... 439/559; 439/610

[58] Field of Search ..... 439/98, 559, 573, 578, 439/584, 585, 610

[56] References Cited

U.S. PATENT DOCUMENTS 4,295,701 10/1981 Gunn ..... 439/559 X
4,739,126 4/1988 Gutter et al. ..... 439/98 X

FOREIGN PATENT DOCUMENTS 0420741 4/1991 European Pat. Off. ..... 439/578
64-73785 3/1989 Japan .
1-122280 8/1989 Japan .

*Primary Examiner*—Eugene F. Desmond
*Attorney, Agent, or Firm*—Armstrong, Westerman, Hattori, McLeland & Naughton

[57] ABSTRACT

A shielded connector is provided which makes connection for shielding and sealing for waterproofing at the same time that the connector is directly mounted on a vehicle instrument such as a motor. A connector housing with a terminal fitting-accommodating hole formed therein is provided with a shielding metal shell, into which accommodating hole is fitted a terminal fitting attached to a shielded cable such that the shield of the shielded cable is connected with the metal shell via a connecting member fitted on the shield. The connector housing is further provided on its outer periphery with a flange for fixing the connector housing in a connector-mounting hole formed in the casing of the instrument and with a seal ring for sealing the mounting hole. The metal shell is extended to have a portion thereof exposed on the surface of the flange facing toward the casing.

8 Claims, 3 Drawing Sheets

INSTRUMENT DIRECTLY MOUNTED SHIELDED CONNECTOR

BACKGROUND OF THE INVENTION

1. Field of the Invention

This invention relates to a shielded connector directly mounted on various electric instruments such as a motor installed, for example, in an electric vehicle and more particularly to a shielded connector which makes connection for shielding and sealing for waterproofing at the same time that the connector is fixed.

2. Description of the Prior Art

Conventionally, when a connector is connected to a vehicle instrument with electromagnetic shielding being made, as shown in FIG. 4A, an LA terminal 32 or the like attached to a cable 31 is inserted into the instrument through an opening 30*a* in an instrument panel 30 and connected with an internal instrument-side terminal, followed by application of a waterproof sealing 33 at the opening and winding with a shielding tape 34. Optionally, a shielding cable 31' with a shielding braid 34' is employed from the beginning as shown in FIG. 4B, followed by applying a sealing 33' for waterproofing.

The winding operation of the shielding tape 34, however, requires man-hours, and differences in winding are likely to be observed among individual operators, resulting in variations in performance. If the shielding cable 31' is employed, it is difficult to securely connect the shielding braid 34'.

Further, to ground the shielding wire of a shielded high voltage cable, a connector is disclosed in Japanese Patent Application Unexamined Publication No. Sho 64-73785, which has a cylindrical portion hermetically fixed, for example, to a laser head, having the connecting part of the high voltage cable conductor inserted therein, and filled with an insulating material, and in which the shielding wire is held between two closures threaded together into the opening of the cylindrical portion. It is difficult, however, to separate the shielding wire from the high voltage cable without giving damage to the shielding wire itself or the inner insulating layer and requires much time of a skilled operator.

SUMMARY OF THE INVENTION

This invention has been accomplished to overcome the above drawbacks and its object is to provide an instrument-directly mounted shielded connector capable of making connection for shielding and sealing for waterproofing at the same time that the connector is mounted.

To achieve the above object, the instrument-directly mounted shielded connector according to this invention comprises: a connector housing with a terminal fitting-accommodating hole formed therein, the accommodating hole being opened at both ends; a terminal fitting for insertion into the accommodating hole, attached to a shielded cable; a metal shell provided on the connector housing for shielding; a connecting member fitted to a shielding member of the shielded cable for connecting the shielding member to the metal shell when the terminal fitting is accommodated in the accommodating hole; a flange provided on an outer periphery of the connector housing for fixing the connector housing in a connector-mounting hole formed in a conductive casing of a vehicle-mounted electric instrument, the metal shell having a portion thereof attached to a surface of the flange opposed to the casing; and a seal ring provided on the outer periphery of the connector housing for sealing the connector-mounting hole.

In the terminal fitting-accommodating hole of the connector housing, the shielding member of the shielded cable is connected with the shielding metal shell via the connecting member fitted to the shielding member, and the metal shell is extended to have a portion thereof attached to the surface of the flange opposed to the instrument conductive casing. Thus, on installing the connector in the connector-mounting hole in the conductive casing, the casing and the metal shell are directly brought into contact with each other, making ground connection for the shielded cable at the same time that the connector is mounted and fixed. Further, since a seal ring is provided on the outer periphery of the connector housing for sealing the connector-mounting hole, sealing for waterproofing is also performed at the same time, leading to a great improvement in operability.

Further objects and advantages of the present invention will be apparent from the following description of the preferred embodiment of the invention as illustrated in the accompanying drawings.

DETAILED DESCRIPTION OF PREFERRED EMBODIMENT

Figure 1:
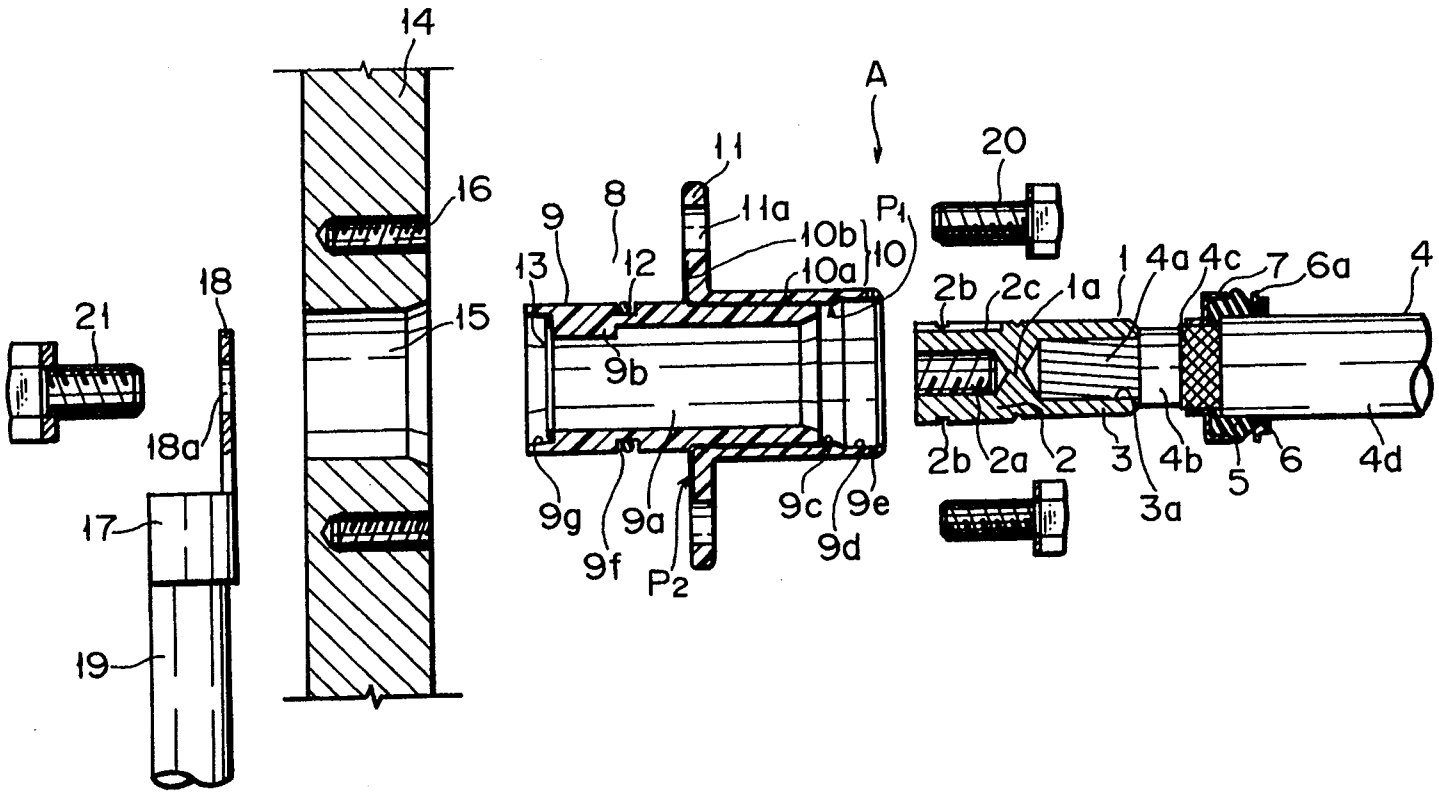
FIG. 1 is an exploded, longitudinal sectional view of an instrument-directly mounted shielded connector according to one embodiment of this invention.

In FIG. 1, designated A is a shielded connector consisting of a cylindrical terminal fitting 1 and a housing 8 for the terminal fitting, the terminal fitting being attached to the terminal of a shielded cable 4.

The terminal fitting 1 is formed at a front half thereof with an electric contact section 2 having a bolt hole 2*a* formed therein and at a rear half thereof with a cable-connecting section 3 having a cable conductor-insertion hole 3*a* formed therein, the holes 2*a* and 3*a* being divided by a central blind wall 1*a*. The terminal fitting 1 is formed by cutting a solid good conductor, e.g., a round copper rod. The electric contact section 2 has on its outer periphery on opposite sides a pair of radial recesses 2*b*, 2*b* and on its outer periphery on one side a longitudinal groove 2*c* that extends axially.

A cable conductor 4*a*, exposed at the terminal of the shielded cable 4 by removing an inner insulating cover layer 4*b*, is inserted into the cable conductor-insertion hole 3*a* of the terminal fitting 1, followed by pinching, to be connected to the cable-connecting section 3. At the end of an outer cover layer 4*d* where a braided shield 4*c* is exposed, a waterproofing rubber stopper 5 is fitted over spanning both the outer cover layer 4*d* and braided shield 4*c*. A holder 6 for the rubber stopper 5, formed with a locking projection 6*a*, is fitted over behind the stopper. A metallic connecting member 7 covers a front half of the rubber stopper 5 in contacted relation with the shield 4c. The shield 4c is extended halfway the exposed inner insulating cover layer 4b so as to prevent contact between a shield wire and the cable conductor 4a.

The connector housing 8 consists of a cylindrical housing body 9, a metal shell 10 partly integrally embedded in the housing body during molding thereof, and a flange 11 circumferentially provided on the outer periphery of the housing body at an intermediate length thereof. The flange is formed with bolt-insertion holes 11a.

The housing body 9 has a terminal fitting-accommodating hole 9a formed therein, which is opened at both ends. The outer peripheral wall of the housing body 9 is thin at a front half and thick at a rear half, forming a step therebetween where the flange 11 is circumferentially provided.

The housing body 9 is provided, on an inner surface at a front portion thereof, with a projected guide strip 9b for the longitudinal groove 2c on the terminal fitting 1 and adjacent the rear end with circumferential engagement walls 9c and 9d stepwise increasing in diameter toward the outside for receiving the rubber stopper 5 and the rubber stopper-holder 6, respectively. A pair of engagement holes 9e, 9e are formed on the inner surface at the rear end of the housing body 9.

The housing body 9 has an annular groove 9f formed on its outer periphery toward the front end for receiving a seal ring 12 and a seat 9g for a C-ring 13 formed inside the front end.

The metal shell 10 consists of a cylindrical main body 10a and a brim portion 10b formed at one end of the main body. The main body 10a is fixed inside the thick portion of the housing body 9 through molding and its rear end portion is exposed along the engagement wall 9c as shown at P1. The brim portion 10b is attached in face-to-face relation to a front surface of the flange 11 to be exposed as shown at P2.

Designated 14 is a metal casing (instrument panel) of a car-mounted electric instrument such as a motor, which is provided with a connector-mounting hole 15 and bolt insertion holes 16. Designated 17 is an instrument-side terminal attached to a cable 19 that connects the electric instrument with a power source, which is provided with a terminal plate 18 with a bolt-insertion hole 18a formed therein. 20 and 21 are bolts.

The assemblage and mounting of the connector A will now be described with reference to FIGS. 2 and 3.

Figure 2:
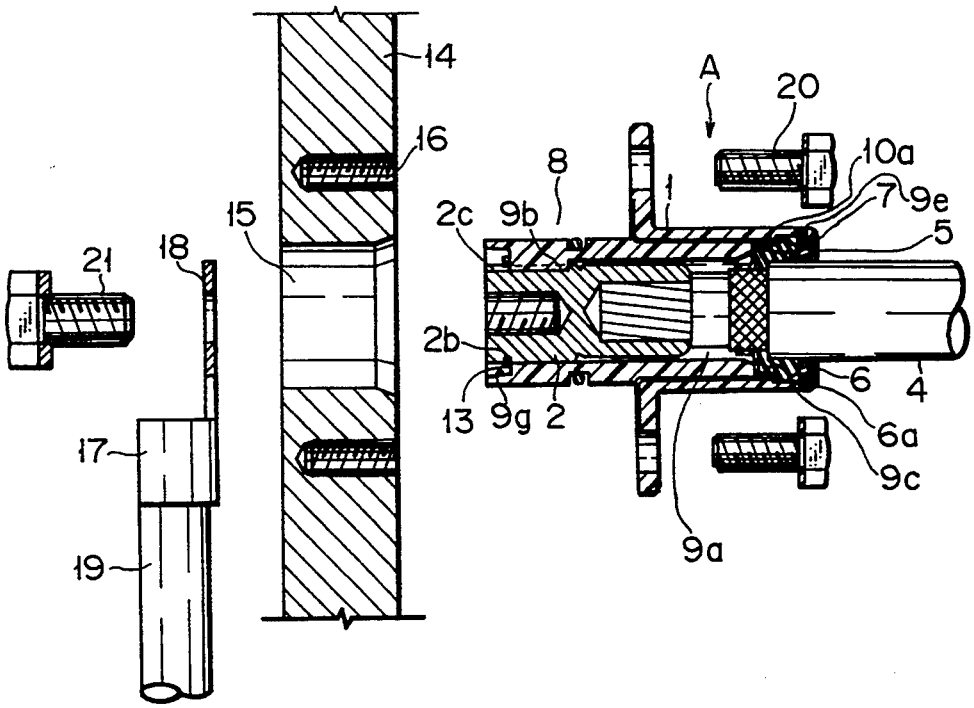
FIG. 2 is a longitudinal sectional view showing the connector of FIG. 1 in the mounting process to an instrument.

The shielded connector A is first assembled as shown in FIG. 2. In other words, the terminal fitting 1 attached to the shielded cable 4 is inserted into the terminal fitting-accommodating hole 9a through the rear end of the connector housing 8. If the terminal fitting 1 abuts against the rear end of the projected guide strip 9b and stops, the terminal fitting 1 or the connector housing 8 is rotated to align the guide strip 9b and the longitudinal groove 2c and to further push the terminal fitting 1.

When the terminal fitting 1 is fully inserted, the rear end of the guide strip 9b contacts the rear end of the longitudinal groove 2c to prevent the terminal fitting 1 from further advancing and forwardly slipping off, while at the same time the rubber stopper 5 is fitted in the engagement wall 9c to seal the housing at the rear end. Concurrently therewith, the connecting member 7 on the rubber stopper 5 is elastically brought into contact, over its entire circumference, with the rear end portion of the main body 10a of the metal shell 10 exposedly laid on the engagement wall 9c. The rubber stopper-holder 6 is also fitted in the engagement wall 9d with its locking projections 6a, 6a engaged with the corresponding engagement holes 9e, 9e at the rear end of the housing body 9.

The C-ring 13 is then placed on the seat 9g at the front end of the terminal fitting-accommodating hole and engaged with the pair of recesses 2b, 2b on the outer periphery near the front end of the terminal fitting 1, so that along with the above-mentioned engagement between the locking projections 6a, 6a and engagement holes 9e, 9e, the fitting is doubly prevented from rearwardly slipping off.

Figure 3:
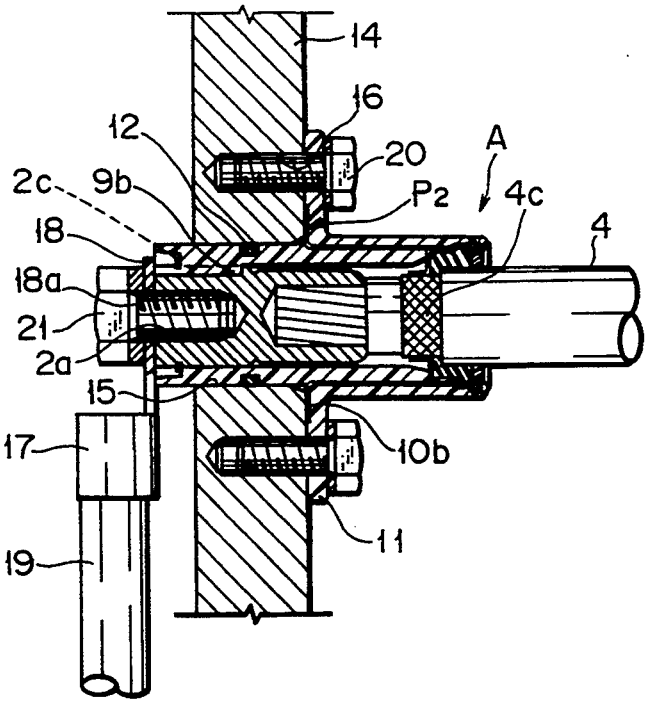
FIG. 3 is a longitudinal sectional view showing the connector of FIG. 1 in the mounted state to the casing.
Figure 4A:
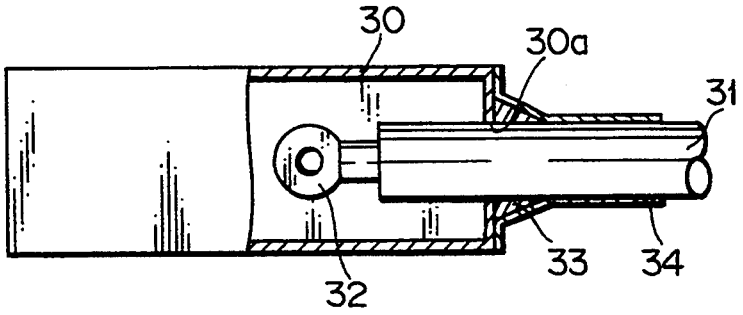
FIG. 4A PRIOR ART
FIGS. 4A and 4B are views showing conventional examples.
Figure 4B:
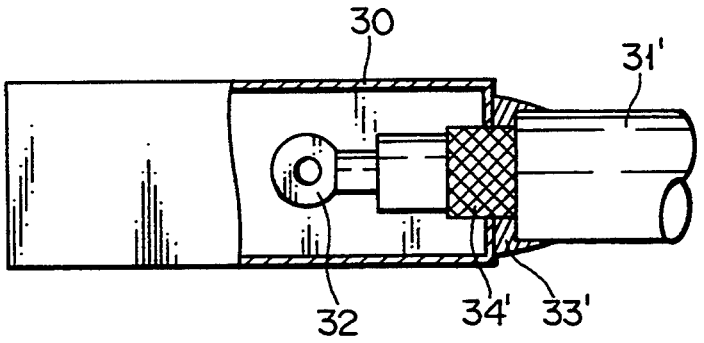
FIG. 4B PRIOR ART

The thus assembled shielded connector A is inserted into the connector-mounting hole 15 in the casing 14 as shown in FIG. 3 and fixed therein by the bolts 20 threaded into the bolt-insertion holes 16, whereby the brim portion 10b of the metal shell 10 on the front surface of the flange 11 is contacted with the metal casing 14 as shown at P2 to ground the shield 4c. The seal ring 12 provided on the outer periphery of the housing body 9 seals the gap between the casing 14 and the connector A.

Finally, the terminal plate 18 of the instrument-side terminal 17 attached to the cable 19 is connected to the electric contact section 2 of the terminal fitting 1. This is simply effected by inserting the bolt 21 into the bolt-insertion hole 18a of the terminal plate 18 and threading same into the bolt hole 2a of the terminal fitting 1. The engagement of the guide strip 9b in the longitudinal groove 2c prevents rotation of the terminal fitting 1 in its accommodating hole 9a during threading of the bolt 21.

If the insertion of the terminal fitting 1 into the terminal fitting-accommodating hole 9a is incomplete in the process of assembling the shielded connector A, i.e., if the guide strip 9b is inserted incomplete into the longitudinal groove 2c on the electric contact section 2 and the rubber stopper 5 is fitted incomplete in the engagement wall 9c to insufficiently contact the connecting member 7 with the metal shell 10, the bolting of the instrument-side terminal 17 as mentioned above drags the terminal fitting 1 forwardly inside the terminal fitting-accommodating hole 9a. As a result, the rubber stopper 5 is fitted complete in the engagement wall 9c, pressing the connecting member 7 against the main body 10a of the metal shell 10 and securing a sound contact therebetween. Thus, disadvantages resulting from incomplete insertion of the terminal fitting 1 such as insufficient contact are eliminated.

While in the above example, the terminal fitting 1 is shown as being connected with the instrument-side terminal 17 with the terminal plate 18 by means of a bolt threaded into the bolt hole 2a formed in the electric contact section 2 of the terminal fitting 1, it is also possible to employ a structure in which, for example, a pin-shaped male terminal is fitted. In this case, the longitudinal groove 2c for preventing the rotation of the electric contact section 2 may be omitted.

The instrument-directly mounted shielded connector of this invention having the construction as mentioned above is capable of making connection for shielding and sealing for waterproofing at the same time that the connector is fixed to an instrument casing, resulting in a marked improvement in operability.

What is claimed is:

1. An instrument-directly mounted shielded connector comprising:

a connector housing with a terminal fitting-accommodating hole formed therein, said accommodating hole being opened at both ends;

a terminal fitting for insertion into said accommodating hole, attached to a shielded cable;

a metal shell provided on said connector housing for shielding;

a connecting member fitted to a shielding member of said shielded cable for connecting said shielding member to said metal shell when said terminal fitting is accommodated in said accommodating hole;

a flange provided on an outer periphery of said connector housing for fixing said connector housing in a connector-mounting hole formed in a conductive casing of a vehicle-mounted electric instrument, said metal shell having a portion thereof attached to a surface of said flange opposed to said casing; and a seal ring provided on said outer periphery of said connector housing for sealing said connector-mounting hole.

2. An instrument-directly mounted shielded connector according to claim 1, wherein said terminal fitting has an axially-extended hole opened at one end of said terminal fitting for allowing a cable conductor of said shielded cable to be fitted therein.

3. An instrument-directly mounted shielded connector according to claim 2, wherein said connecting member is fitted to said shielding member at a position rearwardly spaced from said cable conductor fitted in said axially-extended hole.

4. An instrument-directly mounted shielded connector according to claim 3, wherein said connecting member is supported on a waterproofing rubber stopper such that when said terminal fitting is accommodated in said accommodating hole, said rubber stopper presses said connecting member against said metal shell while at the same time sealing for waterproofing.

5. An instrument-directly mounted shielded connector according to claim 1, wherein said flange on the outer periphery of said connector housing is provided at an intermediate length of said connector housing.

6. An instrument-directly mounted shielded connector according to claim 2, wherein said terminal fitting has an axially-extended threaded hole opened at the other end of said terminal fitting for allowing an instrument-side terminal to be bolted from the side of said casing opposite to said connector housing.

7. An instrument-directly mounted shielded connector according to claim 6, wherein said connector housing is on an inner surface thereof provided with a means engageable with said terminal fitting for preventing rotation thereof when said instrument-side terminal is bolted.

8. An instrument-directly mounted shielded connector according to claim 1, wherein said metal shell is embedded in a wall of said connector housing exclusive of said portion attached to said surface of the flange and a portion connected to said shielding member via said connecting member.

* * * * *